US006074282A

United States Patent [19]

Schimweg

[11] Patent Number: 6,074,282

[45] Date of Patent: Jun. 13, 2000

[54] EXTERNAL HONE AND METHOD OF MAKING AND USING THE SAME

[75] Inventor: John J. Schimweg, St. Charles, Mo.

[73] Assignee: Sunnen Products Company, St. Louis, Mo.

[21] Appl. No.: 08/824,850

[22] Filed: Mar. 26, 1997

[51] Int. Cl.[7] ..... B24D 11/00

[52] U.S. Cl. ..... 451/49; 451/51; 451/119; 451/164; 451/464; 451/487

[58] Field of Search ..... 451/49, 57, 51, 451/58, 119, 162, 164, 425, 487, 464, 526, 533, 538, 539, 552, 553, 554, 555, 556

[56] References Cited

U.S. PATENT DOCUMENTS

| | | | |
|---|---|---|---|
| 1,086,698 | 2/1914 | Baulig . | |
| 2,163,425 | 6/1939 | Emerson | 51/73 |
| 2,195,493 | 4/1940 | McGovern et al. | 51/184.2 |
| 2,344,036 | 3/1944 | Franck | 51/204 |
| 3,335,526 | 8/1967 | Weiss | 51/73 |
| 4,233,783 | 11/1980 | Stark | 51/73 |
| 4,253,279 | 3/1981 | Althen | 51/1 |
| 4,665,657 | 5/1987 | Rands et al. | 51/103 |
| 5,178,643 | 1/1993 | Schimweg | 51/293 |
| 5,564,972 | 10/1996 | Marvin et al. | 451/526 |

FOREIGN PATENT DOCUMENTS

| | | |
|---|---|---|
| 2334667 | 1/1975 | Germany . |
| 2903162 | 7/1980 | Germany . |
| 3300860 | 11/1983 | Germany . |

*Primary Examiner*—Eileen P. Morgan

*Attorney, Agent, or Firm*—Haverstock, Garrett & Roberts LLP

[57] ABSTRACT

A honing member for use in honing the external cylindrical surface of a workpiece comprising an elongated annular member having a passageway extending the entire length therethrough, the inner annular surface of such passageway having abrasive particles attached directly thereto or formed integrally therewith, the inner annular surface being substantially cylindrical in shape and having at least one tapered portion adjacent one end portion of the honing member, and a slot formed through one side portion of the annular member extending the full length thereof to facilitate expansion and contraction thereof to radially adjust the diameter of the inner surface of the annular member. In a preferred embodiment, the present honing member is formed through the use of an electroplating or electro-forming process using a forming mandrel, and the inner annular surface of such honing member includes at least two tapered abrasive portions and a substantially cylindrical portion which establishes the final diameter to which the external cylindrical surface of a workpiece will be honed. Attaching or integrally forming the abrasive particles directly onto the inner surface of the honing member facilitates the dissipation of heat generated during a honing operation and provides a better support platform for the abrasive particles thereby increasing both the longevity of the honing member as well as the accuracy and consistency of honing cylindrical workpiece surfaces to very precise tolerances. Several embodiments of the present honing member are disclosed herein including several methods of manufacture, several methods of using the present honing members, and several mounting fixtures capable of supporting the present honing members in either a horizontal or a vertical honing position.

36 Claims, 6 Drawing Sheets

EXTERNAL HONE AND METHOD OF MAKING AND USING THE SAME

The present invention is directed to the construction, method of manufacturing, and method of using an external honing device such as a device for honing the external cylindrical surfaces of members including especially a device for accurately honing such surfaces by moving the workpiece and the honing member relative to each other in a single or multiple stroke operation.

BACKGROUND OF THE INVENTION

For a long time there has been a need to be able to accurately hone external surfaces of cylindrical members in a manner that produces an extremely accurate surface of a predetermined size or diameter and preferably to do so by a single stroking operation of the honing member rotating relative to the workpiece. Devices for accomplishing the same have been achieved by internal honing devices including the internal honing device disclosed in Althen U.S. Pat. No. 4,253,279. The Althen patent is assigned to Applicant's Assignee and involves some similar techniques for achieving extremely precise honing operations but on internal bore surfaces rather than on external cylindrical surfaces.

In the past, external finishing of a workpiece has been previously accomplished by grinding or turning, or by using an external lapping hand tool. More recently, Marvin et al U.S. Pat. No. 5,564,972 discloses an outside diameter finishing tool for low tolerance finishing of the outer surfaces of generally cylindrical workpieces such as piston rods. The Marvin et al apparatus includes an outer metallic shell, an inner abrasive layer, and an epoxy or resin layer therebetween, the inner abrasive layer being located on the inner surface of the epoxy or resin layer. The method of forming the Marvin et al tool includes electro-forming the abrasive layer around the outer surface of a rod member which includes a central cylindrical portion as well as an outwardly tapered portion. After the abrasive layer is formed on the outer surface of the rod, the rod is inserted within the metallic shell such that an annular space is maintained between the inner surface of the metallic shell and the abrasive layer formed on the outer surface of the rod. The space is then filled with an epoxy or resin material and, upon curing, the epoxy or resin layer secures the abrasive coated rod within the metallic shell forming a composite structure consisting of the metallic shell, the epoxy or resin layer, the abrasive layer and the rod. The rod is then removed by immersing the composite structure into a caustic solution which dissolves the rod, or by removing the rod by grinding it away. Removal of the rod results in the abrasive layer being attached to the metallic shell solely by the epoxy or resin layer.

One of the main advantages of the present construction over known prior art constructions including the device disclosed in Marvin et al U.S. Pat. No. 5,564,972 is the fact that in the present construction the abrasive layer which is preferably a superabrasive layer is attached to the inner surface of a metal member preferably by means of a metal plating process. This means that with the present construction, there is better support for the abrasive member. This is important when using superabrasives because it means the tool can be used to hone many more surfaces without replacement and can be adjusted, within limits, to maintain a certain diameter for the parts being honed and at the same time compensate for wear of the abrasive layer. The present construction also is advantageous in that the thickness of the layer of the abrasive material can be varied in a relatively easy manner as it is applied to the inner surface of the honing member. This is important in many applications because the first portion of the honing surface preferably has a steeper taper than the other portions and there may be more than one tapered portion at the entrance end of the honing member. In such a construction, most of the abrading will take place in the first portion that engages the work surface and a lesser amount of abrading and also a polishing effect will be produced by the lesser tapered and/or cylindrical portions of the honing member.

In the Marvin et al device, "a substrate material 20, preferably epoxy, secures the inner surface of the abrasive layer 22 within the shell 16". See column 4, lines 16–18. As a result, the Marvin et al abrasive layer, which also may be a superabrasive layer, is located on a layer of epoxy or resin which, by its very nature, is relatively more subject to changes and does not provide the same heat dissipating and support characteristics for the abrasive layer that is provided when the abrasive layer is plated directly onto a metal member such as a member constructed of nickel, iron, copper, chrome and/or various other alloys. The present external honing tool construction therefore provides a more durable and longer lasting tool which includes improved means for both supporting the abrasive layer on the inner surface of the tool as well as dissipating the heat generated during a honing process, all of which increase the accuracy and consistency of honing cylindrical workpiece surfaces to very small tolerances.

SUMMARY OF THE INVENTION

The present invention teaches the construction and operation of several embodiments of an external honing member including means for supporting the honing member and for making adjustments to such member to compensate for wear of the abrasive material associated therewith. Each of the present honing member constructions includes an elongated annular member having an opening or passageway extending the entire length therethrough, the inner annular surface of such passageway including abrasive particles attached to or formed integral with at least a portion thereof. In operation, the workpiece to be honed is generally reciprocated one or more times through the inner passageway of the honing member to hone the outside diameter of the workpiece to a desired final diameter.

In the preferred embodiment, superabrasive materials such as diamond particles or particles of cubic boron nitride are formed integral with the inside annular surface of the honing member such as by an electroplating or electroforming process. Several methods of forming the abrasive layer adjacent the inner periphery of the honing member are disclosed herein. Regardless of the method utilized, it is important to the present invention that the abrasive layer be applied directly to or be formed integral with the metal surface of the honing member since this provides an efficient means for the heat generated during a honing operation to escape or dissipate through the metal material which forms the honing member and also through the support means associated therewith.

Also, importantly, of special importance to the present honing member is the shape of the inner annular surface upon which the abrasive material is formed or otherwise attached. In this regard, the inlet portion of the inner surface of the honing member may include one or more tapered portions followed by a substantially cylindrical portion which will control the final diameter of the cylindrical surface of the workpiece that is being honed. The tapered inlet portion may include a relatively steep first tapered portion followed by one or more less tapered portions or by a substantially straight or cylindrical portion, the more steeply tapered abrasive portion providing a more aggressive cutting action and removing more stock material as compared to the less tapered abrasive portions or the straight or cylindrical portion which serve to finish and polish the outside cylindrical surface of the workpiece. As the workpiece is fed through the honing member one or more times, the smallest inside diameter portion of the honing member will undergo less pressure and will be able to more accurately finish and size the workpiece surface. It is recognized and anticipated that various combinations of tapered and straight sections can be used in combination with the present invention including incorporating a reversed taper on the outlet end portion of the inner surface of the honing member.

Each of the various embodiments of the present honing member likewise include a narrow slot or groove, linear or otherwise, which extends along the full length of the honing member on one side thereof to enable such member to expand and contract when means are engaged therewith to change the inside diameter of the honing member. This ability is important because it enables a user to expand or contract the inner honing diameter of the tool, albeit over relatively narrow ranges, to both compensate for wear of the abrasive material over the life of the honing member and to slightly change the honing diameter of the member to hone a much wider range of surface diameters than has been heretofore possible using prior art external honing devices.

The preferred embodiment of the present honing member is made by using a forming mandrel upon which the abrasive annular honing member is formed. In the preferred method of manufacturing, one or more abrasive material layers are formed upon the forming mandrel utilizing an electroplating process, and successive layers of non-abrasive metal such as nickel, iron, copper, chrome and/or various alloys are thereafter formed directly over the abrasive layer to a desired outside diameter utilizing the same electroplating process. With the mandrel in place, the outside diameter of the honing member is then ground or otherwise machined to the proper finished outside diameter and other machining processes can likewise be performed. After the forming mandrel has been removed from the honing member formed therearound, additional post-operations can be accomplished on the honing member including machining or otherwise cutting the full length expansion/contraction slot or groove through one side portion thereof.

Although the forming mandrel is typically made of a stainless steel or other metal material, it could likewise be formed from a wax, plastic, or some other deformable material which could be later removed once the honing member was formed therearound such as by destroying the non-permanent forming mandrel through a heat or melting process, or through some other method such as a chemical destruction process. The forming mandrel can also take on many different shapes and sizes, the outside surface shape and characteristics of the mandrel determining the size and shape of the inner annular surface of the honing member such as the various inlet and outlet tapers discussed above. Also, the forming mandrel can be suitably masked so as to form helical grooves on the inner surface of the honing member for conducting honing oil or other coolant therethrough during a honing operation.

Other methods for forming the various embodiments of the present honing member are likewise anticipated and recognized such as forming the same through a powdered metal compaction process wherein the proper powder mixture is placed between two concentric sleeve members, the outer surface of the inner sleeve member conforming to the shape of the inner surface of the resultant honing member. The powdered metal compaction process includes sintering or otherwise applying heat and pressure to the compaction material so as to form a solid unitary structure therefrom.

Other embodiments and variations of the present external honing member are disclosed herein including an embodiment which uses elongated abrasive sticks mountable within channels extending longitudinally along at least a portion of the inner annular surface of the honing member. Also, various mounting assemblies onto which the present honing members can be held and supported in an operative position for a honing operation are also disclosed, one embodiment enabling the present honing members to be utilized in a horizontally oriented honing operation whereas another assembly is disclosed wherein the present honing members can be utilized in a vertically oriented honing operation. Still further, although the present honing member constructions are especially adaptable for use in single pass honing applications, such honing members are likewise adaptable for use in multi-stroke honing applications including use on multi-spindle bore sizing or honing machines wherein each spindle has a differently sized external honing member attached thereto such that workpieces can be continuously cycled on the machine with each of the various honing members progressively reducing the outside diameter of the workpiece. In addition, each external honing member may also have a different size abrasive grit associated therewith to likewise progressively produce a finer surface texture. The present constructions are believed to permit more accurate and more uniform finishing and sizing of the work surfaces in an external hone operation. All of the features and capabilities afforded by the present honing members represent important advancements in the external honing art.

It is therefore a principal object of the present invention to teach the construction and operation of a novel honing tool designed specifically to accurately hone external cylindrical surfaces of workpieces and to do so very accurately and preferably by a single stroke cycle of the honing tool relative to the workpiece.

Another object is to provide a honing device for honing external surfaces that prevents overheating by having improved means for dissipating heat generated during honing.

Another object is to be able to hone more external surfaces in a given period of time.

Another object is to teach the construction, operation, and adjustability of an external honing device which can be used to hone a larger number of workpieces to some exact desired size or diameter and which can do so with little or no wear of the abrasive surface.

Another object is to teach the construction and operation of an external honing member which can be adjusted over a very narrow range of sizes to thereby substantially increase the number of workpieces that can be honed by the same member and to the same precise accuracy.

Another object is to provide relatively improved means for supporting an external honing device.

Another object is to increase the accuracy and consistency of cylindrical workpiece surfaces honed by an external honing device.

Another object is to provide better and more efficient means for dissipating heat produced during honing of external surfaces.

Another object is to provide an external honing device that can be adjusted to compensate for wear so that all parts honed therewith have the same final accurate dimension.

Another object is to teach a novel method for manufacturing an external honing tool which involves electroplating abrasive materials onto the inner surfaces of metallic honing members.

These and other objects and advantages of the present invention will become apparent to those skilled in the art after considering the following detailed specification which describes several embodiments of the construction and operation of tools used for honing external cylindrical surfaces.

BRIEF DESCRIPTION OF THE PREFERRED EMBODIMENTS

Figure 1:
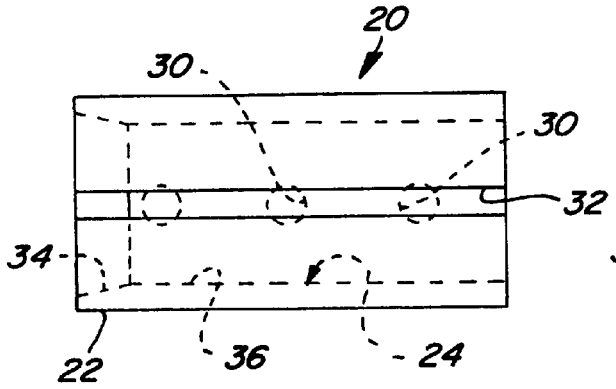
FIG. 1 is a side elevational view of a honing member used for honing external cylindrical surfaces of workpieces constructed according to the teachings of the present invention.
Figure 2:
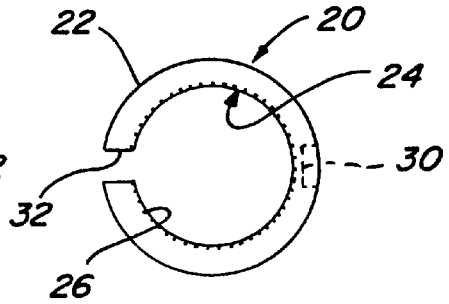
FIG. 2 is a right end view of the honing member shown in FIG. 1.
Figure 4:
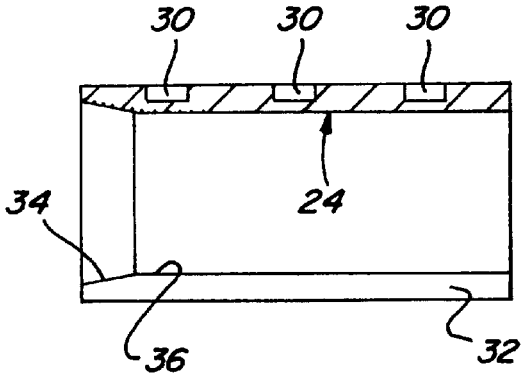
FIG. 4 is a cross-sectional view taken along line 4—4 of FIG. 3.
Figure 3:
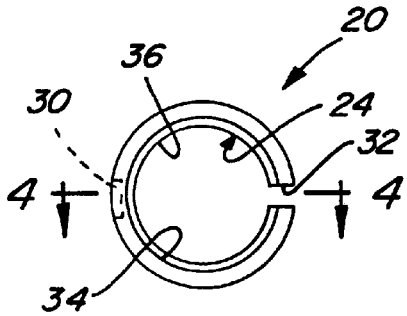
FIG. 3 is a left end view of the honing member shown in FIG. 1.

Referring to the drawings more particularly by reference numbers wherein like numbers refer to like parts, number 20 in FIG. 1 identifies a honing member or sleeve element constructed according to the teachings of the present invention, which member 20 is used for honing the external cylindrical surfaces of workpieces. The device 20 is an elongated annular or tubular metal member having an external cylindrical surface 22 and an internal cylindrical surface 24. The internal surface 24 is plated with one or more layers of an abrasive substance 26 and the abrasive surface extends substantially entirely around the inner periphery of the member 20 as best shown in FIG. 2. (When used throughout this disclosure, the term "abrasive layer" is intended to mean one or more layers of an abrasive grit or other abrasive material which is plated or otherwise formed on a particular surface.) The member 20 also includes at least one, and in the embodiment shown in FIG. 1, three axially aligned counterbores 30 positioned at predetermined locations as shown in FIGS. 1 and 4. The counterbores 30 are used for properly positioning and holding the honing member 20 within a suitable mounting fixture as will be hereinafter explained. The member 20 also includes an axially extending opening or slot 32 which extends the length thereof. The purpose for the opening 32 is to enable the member 20 to be expanded or contracted by some small amount, as will be likewise hereinafter explained, in order to adjust the honing diameter of the member 20 and to compensate for wear of the abrasive layer 26. If a superabrasive material such as cubic boron nitride or a layer of diamond particles is used as the abrasive layer 26, the diameter of the honing surface will be able to be varied by an amount to compensate for wear of the abrasive layer and to enable the same tool to be used to hone many more surfaces than would otherwise be the case. The manner in which the diameter of the present honing member 20 is varied will be described in more detail hereinafter. As best shown in FIGS. 1–4, the counterbores 30 are located directly opposite the opening 32.

Of special importance to the present invention is the shape of the annular inner surface 24 on which the abrasive material is formed or attached. In the preferred form of the invention, the inner surface 24 (FIG. 4) is shown having a relatively steeply tapered inlet end portion 34, and a less tapered or cylindrical portion 36. This means that when a workpiece having a cylindrical surface to be honed is moved axially into and through the member 20, while one of the members is rotating relative to the other, the rate of honing and the honing pressure will be greatest when the surface being honed moves into engagement with the more steeply tapered abrasive surface portion 34. Thereafter, the second less steeply tapered or cylindrical portion 36 of the inner surface 24 will be encountered by the workpiece to finish and polish the workpiece surface. This is done by moving the workpiece through the honing member 20 one or more times. The important thing is that the final diameter of the bore 24, which is the minimum diameter portion, will control the final diameter of the cylindrical surface of the workpiece that is being honed. It also means that the smallest diameter portion of the hone will undergo less pressure and will be able to more accurately finish and size the workpiece surface.

Figure 4A:
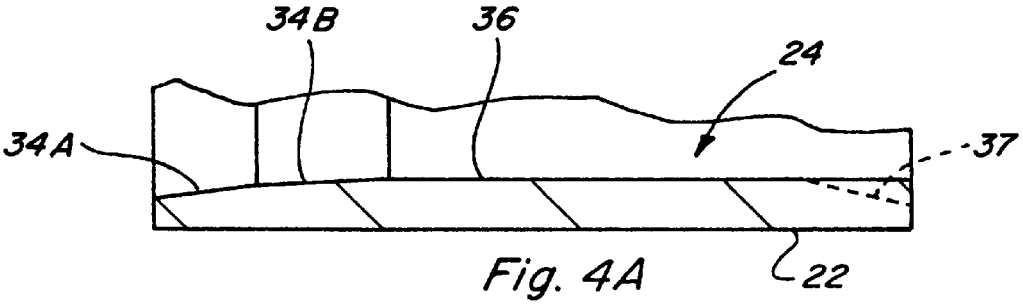
FIG. 4A is an enlarged fragmentary cross-sectional view of the inside surface of the present honing member showing one embodiment of such surface with associated tapered portions.
Figure 4B:
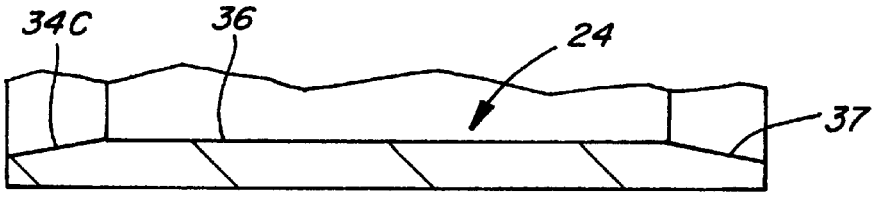
FIG. 4B is an enlarged fragmentary cross-sectional view similar to FIG. 4A but showing another embodiment of the inside surface of the present honing member.

FIGS. 4A and 4B are provided to illustrate various taper arrangements which can be incorporated into the shape of the inner annular surface 24 of the honing member 20. For example, FIG. 4A shows the inside surface 24 of the honing member 20 having two stepped or tapered inlet portions 34A and 34B and a trailing portion 36 which is substantially cylindrical and which portion 36 determines the final workpiece diameter. An optional trailing reverse tapered portion 37 can also be provided if desired. FIG. 4B, on the other hand, is similar to FIG. 4A but shows an inside surface construction wherein there is a single relatively steeply tapered portion 34C at the beginning of the honing surface 24 and another portion 36 extending from the inlet tapered portion 34C to or adjacent to an opposite reverse tapered portion 37 at the opposite end of the honing member, the inside surface portion 36 again being substantially cylindrical and determining the final workpiece diameter.

Figure 5:
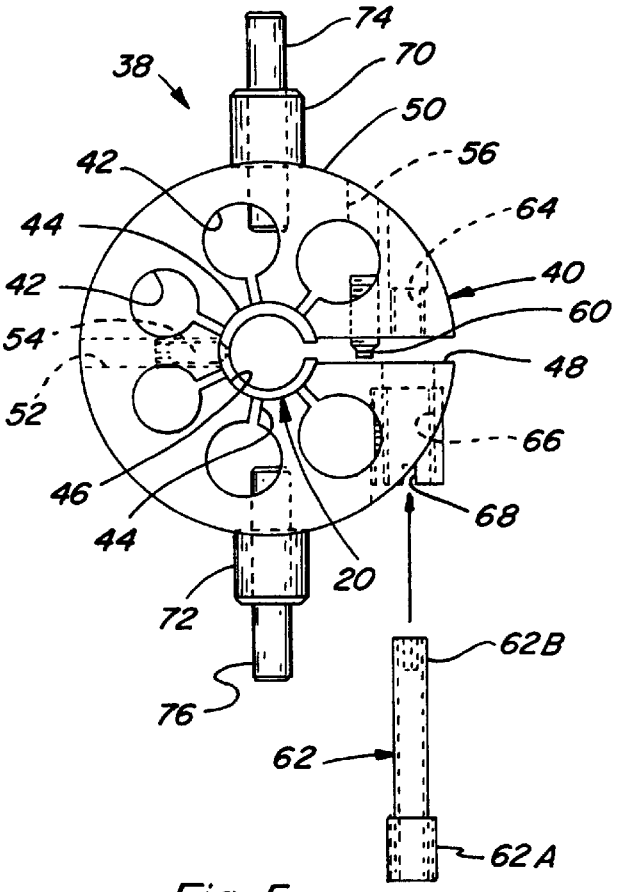
FIG. 5 is a front elevational view of a mounting fixture which may be used for supporting the present honing member shown in FIGS. 1–4 in a horizontal honing position.
Figure 6:
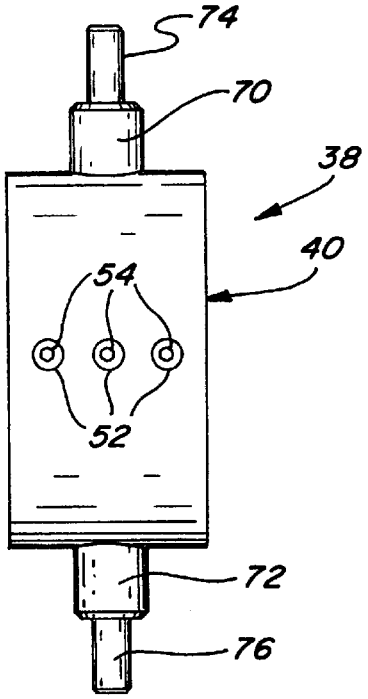
FIG. 6 is a left side view of the mounting fixture shown in FIG. 5.

FIGS. 5 and 6 show a mounting assembly 38 onto which the present honing member 20 may be mounted. The mounting assembly 38 includes a member 40 which has a thickness (FIG. 6) that approximates the length of the honing member 20. The mounting member 40 is substantially cylindrical and has a plurality of round passageways or openings 42 circumferentially spaced around the member 40 as best shown in FIG. 5. The diameters of the passageways 42 can be varied as shown to equalize the supporting force on the honing member. Each of the passageways 42 has a narrow side passage 44 which extends between and communicates with the respective passageway 42 and an inner passageway 46 centrally located in the member 40. The center passageway 46 is the passageway in which the honing member 20 is mounted as shown. The member 40 also has a radially extending opening or passageway 48 which likewise extends between and communicates with the passageway 46 and outer surface 50 of the member 40. When the honing member 20 is mounted in the passageway 46, the longitudinal opening 32 is aligned with the passageway 48. The reasons for this will become apparent in what follows. The honing member 20 is shown having three counterbores 30 positioned on the opposite side of the member 20 from the full length opening 32. When the honing member 20 is positioned within the passageway or bore 46, the counterbores 30 will be aligned with respective threaded openings 52 (FIG. 6) in the mounting member 40. Each of the openings 52 will receive a threaded member 54 which is threaded inwardly until its inner end terminal portion engages the respective counter bore 30. This properly positions and holds the honing member 20 in position within the passageway 46 with the opening 32 in alignment with the opening 48 in the mounting member 40 as best illustrated in FIG. 5. It is recognized and anticipated that other means for positioning and holding the honing member in proper position within the mounting member 40 may likewise be utilized without departing from the spirit and scope of the invention.

The mounting member 40 also includes other bores including a threaded bore 56 which receives a threaded member 58 which has an end portion 60 that is adjustable to be positioned in spaced relationship to one side of the opening 48. The position of adjustment for the member 58 controls the maximum amount of adjustment that can be made as to the width of the opening 48 and hence also the opening 32. The width of the opening 48 is adjustable by means of an adjusting screw assembly 62. The adjusting screw assembly 62 extends through aligned bores 64 and 66 as shown in FIG. 5. When the adjusting screw assembly 62 is positioned in the aligned bores 64 and 66, it can be adjusted to vary the spacing between one side of the opening 48 and the end portion 60 of the adjusting screw 58. Contraction or expansion of the opening 48 imparts corresponding forces on the honing member 20 through the mounting member 40 to correspondingly vary the width of the honing member opening 32 thereby changing the diameter of the inner abrasive surface of the member 20.

Since the honing diameter is controlled by the spacing between the opposite sides of the opening 32 in the honing member 20, it can be seen that by properly adjusting the width of this opening, the honing diameter can be varied. The amount that the honing diameter can be varied in this matter is relatively small but covers a range of adjustment that is necessary to both compensate for wear of the honing surfaces 34–36 and to slightly change the honing diameter to hone a much wider range of surface diameters. This small amount of adjustment is certainly sufficient when super hard abrasive materials are used since such materials wear very little. This adjustment means therefore enables the present honing tool to be able to hone many more parts than otherwise would be possible if some means were not provided to adjust for even minute amounts of wear on the honing surfaces.

As illustrated in FIG. 5, the adjustment assembly 62 extends through the passageways 64 and 66 and across the space formed by the opening 48. Adjustment of the screw assembly 62 can be made by using a screwdriver, wrench or like tool, which tool can be inserted into the slot 68. By rotating the screw 62 in the desired manner, portions of the fixture 40 on opposite sides of the opening 48 are pulled together or allowed to move a very slight distance in order to change the honing diameter of the member 20. The member 58 which is threaded into the passageway 56 provides stop means to limit the maximum amount of possible adjustment. The adjusting screw 58 can also be positioned and set such that the end portion 60 will prevent the honing member 20 from being contracted beyond the final diameter set for the cylindrical surface of a particular workpiece.

Also, importantly, since the adjustment range achieved by rotation of the screw assembly 62 is, in fact, relatively small, such small changes in the width of the opening 48 can be accomplished by using a differential thread arrangement with respect to bores 64 and 66 and the threads associated with the head and end portions 62A and 62B respectively of screw assembly 62. For example, the threaded portions 62A and 62B of screw assembly 62 can be of slightly different thread pitch, the external threads of screw end portion 62B being cooperatively engageable with the internal threads associated with bore 64 whereas the external threads of screw head portion 62A are cooperatively engageable with the internal threads associated with bore 66. Since the thread portions 62A and 62B are of slightly different pitch, rotation of the screw adjustment assembly 62 will produce slight relative axial movement between the opposed sides of the opening 48 and this in turn will produce slight changes in the inner diameter of the member 20 as previously explained. The relative axial movement between the opposed sides of the opening 48 will equal the difference between the axial advancement caused by each of the two different thread pitches utilized. Although the above-described mechanism for adjusting and changing the diameter of the inner surface of the member 20 is generally preferred, it is recognized and anticipated that other means for adjusting the width of the openings 32 and 48 could likewise be utilized including a conventional clamping arrangement wherein the honing member 20 is positionable within a conventional C-shaped clamp which includes means for expanding and/or contracting the clamp around the member 20 to exert a corresponding force thereagainst.

The mounting member 40 also contains upper and lower support members or gimbals 70, 72, 74 and 76. The members 74 and 76 extend through passages formed in the respective members 70 and 72 and support the fixture or holder 40 during honing but with some freedom in all directions. During honing, the workpiece is moved through the member 20 into engagement with the abrasive layer. The gimbal arrangement enables the fixture 40 to be easily maneuvered into engagement with the workpiece such that no biasing forces are exerted on the workpiece during a honing operation. Also, such gimbal arrangement enables the fixture 40 to be easily adjusted and/or rotated so as to avoid the exertion of any bending or other biasing forces on the honing member 20 when the member 20 is expanded or contracted. This arrangement ensures accuracy and consistency throughout the honing operation.

Figure 7:
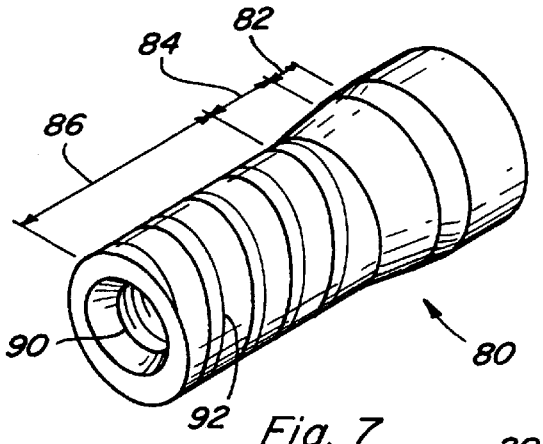
FIG. 7 is a perspective view of a forming mandrel which is used to both form the honing member and to plate the abrasive on the inner surface thereof.
Figure 9:
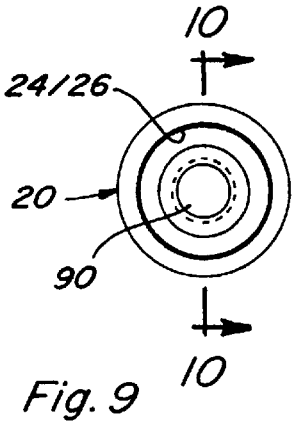
FIG. 9 is a right end view of the honing member and forming mandrel combination shown in FIG. 8.
Figure 8:
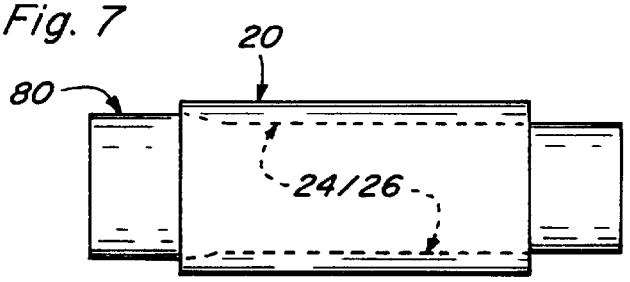
FIG. 8 is a side elevational view of the honing member shown in FIGS. 1–4 formed on the forming mandrel of FIG. 7.

The preferred method for fabricating the honing member 20 of the present invention is through the use of a forming mandrel such as the forming mandrel 80 illustrated in FIG. 7. This is preferably accomplished through the use of an electro-forming process, although other processes such as a powdered metal compaction process may likewise be utilized. The shape and configuration of the outer surface of the forming mandrel 80 will determine the shape and configuration of the inner abrasive surface of the present honing member when the present tool is formed thereon. For example, the outer surface of the forming mandrel 80 includes a steeper lead-in tapered portion 82, a second less tapered portion 84, and a substantially cylindrical portion 86. In this regard, it is recognized and anticipated that the outer surface of the member 80 may be substantially cylindrical over its entire length, or such outer surface may have one or more tapered portions such as the portions 82 and 84 illustrated in FIG. 7, including a substantially cylindrical portion such as the portion 86 as well as a reverse tapered portion (not shown). Regardless of the particular shape and configuration of the outer surface of the forming mandrel, the present honing member such as the member 20 illustrated in FIGS. 1–4 is electroplated directly onto the forming mandrel 80 in the following manner.

Although any suitable means for attaching or bonding the abrasive particles to a substrate member may be utilized without impairing the teachings of the present invention, an electroplating process is generally preferred. In this regard, single or multiple layers of a superabrasive material such as diamond particles and/or cubic boron nitride particles are directly plated onto the outer surface of the forming mandrel 80 using known techniques. This may be accomplished by positioning and holding the abrasive particles against the outer surface of the forming mandrel in an electroplating bath and thereafter applying an initial thin layer of an electroplated material thereagainst in order to hold and attach the adjacent first layer of particles to each other around the outer surface of the mandrel 80. Well known electroplating processes are available for accomplishing this task. Electroplated materials typically used for this type of bond application include such metals such nickel, copper, cobalt and chromium; such metal alloys as nickel phosphorous, nickel boron and brass; and other materials including autocatalytic or electroless plating. Autocatalytic plating refers to a process wherein the deposit material itself catalyzes the reduction reaction at the tool surface. In any event, any number of layers of metal containing abrasive particles can be electroplated onto the outer surface of the mandrel 80 to any predetermined height based upon many factors including the abrasive grit size used as well as the particular honing application involved. Subsequent layers of metal are then electroplated over the innermost abrasive containing layer or layers until a desired rough thickness for the tool sleeve is achieved. This metal may include nickel, iron, copper, chrome or various other alloys. A more detailed description of the known plating methods for bonding superabrasive particles to a particular tool substrate are set forth in Applicant's U.S. Pat. No. 5,178,643.

Figure 10:
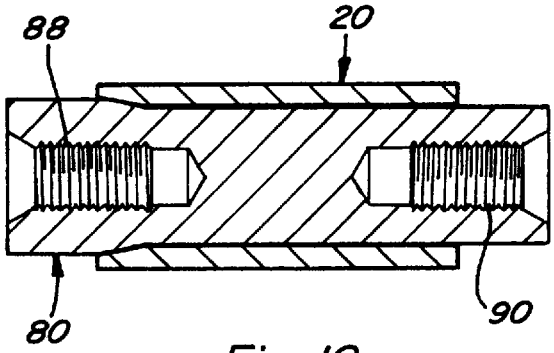
FIG. 10 is cross-sectional view taken along line 10—10 of FIG. 9.

As best shown in FIG. 10, the forming mandrel 80 includes threaded counterbores 88 and 90 extending into opposite ends of the member 80. These counterbores 88 and 90 can be used to cooperatively receive threaded rod members and other fixturing apparatus which is utilized for properly positioning the forming mandrel 80 in an electroplating bath or other abrasive layer forming process. These same outwardly extending rod members or other fixturing apparatus can likewise be utilized to properly position the forming mandrel 80 with the honing member 20 formed thereon for accomplishing several post-machining operations. For example, once the electroplating process has been completed and the honing member 20 has been formed on the mandrel 80 as previously explained, the counterbores 30 as best shown in FIGS. 1–4 are cut, machined, or burned into the honing member 20 while the member 20 is still positioned on the forming mandrel 80. In addition, with the member 20 still positioned on the mandrel 80, the outermost electroplated metal layer is then ground to a desired finished outside diameter for the tool. In both of these operations, the rod members engaged with the counterbores 88 and 90 are used to hold and align the members 20 and 80 on appropriate machinery to accomplish these tasks. Once these operations are completed, the mandrel 80 is removed from the member 20 and the longitudinally or axially extending slot or opening 32 is cut or otherwise machined into the member 20. The counterbores 88 and 90 can likewise be used to remove the forming member 80 from the honing member 20 when the plating process is completed.

Removal of the present honing member or tool 20 from the forming mandrel 80 can be facilitated by applying a separating or parting agent to the outer surface of the mandrel 80 prior to starting the plating process. Also, in this regard, the forming mandrel 80 can be made from a wax, plastic or some other non-permanent deformable type material which could be later separated and removed from the honing member formed therearound such as by destroying the forming mandrel through a heat or melting process, or through a chemical destruction process, or some other method. In addition, regardless of the particular construction and material composition of the forming mandrel 80, it is also desirable to form a helical groove or some other fluting arrangement on the inner abrasive surface of the honing member 20 such that honing oil or other lubricant can pass through such fluting during a honing operation in order to facilitate both cooling and stock and/or chip removal. This fluting is not limited to just a helical pattern, but can be comprised of any interruption of the inner surface of the honing member 20. This fluting arrangement is accomplished by suitably masking the outer surface of the forming mandrel 80 prior to the plating process to form a helical band, strip, or other fluting arrangement such as the masking strip 92 illustrated in FIG. 7. This masking can be achieved through the use of tape, wax, or other wax-like materials which extend around the outer surface of the member 80 in the area where the abrasive particles will be plated thereto. The abrasive particles forming the inner surface of the honing member 20 will not readily attach to the forming mandrel 80 in the area of the masked strip 92 thereby forming the desired fluting through which the honing lubricant can flow.

Although the above-described method of electro-forming the honing member 20 around the forming mandrel 80 is generally preferred, it is also recognized and anticipated that other methods for fabricating the honing member 20 may likewise be utilized. For example, the abrasive honing member 20 can likewise be fabricated through a powdered metal compaction process. This can be accomplished by placing the proper powder mixture between two concentric sleeve members, the outer surface of the inner sleeve member conforming to the shape of the inner surface of the abrasive honing sleeve member being fabricated such as having one or more tapered portions associated therewith, a cylindrical portion, a reversed tapered portion, or any combination thereof as previously explained. The powder mixture would include both the proper abrasive grit particles as well as the appropriate metal or metal alloys forming the end product. The powdered metal abrasive mixture is then compacted and sintered, or hot pressed and coined, so as to form a solid unitary member similar to honing member 20.

Still further, it is also possible to machine-form the honing member 20 out of any suitable material. In this particular situation, the abrasive material can be attached to the inner surface of the honing sleeve by a plating process such as that disclosed in Applicant's U.S. Pat. No. 5,178,643. It is also possible to attach the abrasive particles to the inner surface of the honing member by brazing, investment-casting, cementing, or other suitable methods.

Regardless of how the present honing member 20 is formed, it is important to the present invention to have the abrasive material applied directly to the inner surface of the honing tool such as the metal honing member 20. This means that the abrasive, when it heats up during honing, will be able to efficiently dissipate the heat into the surrounding metal parts with which it is in contact. This is important because it enables the present tool to be used to hone many parts in a continuous sequence without over heating. In prior art devices, such as the device shown in Marvin et al U.S. Pat. No. 5,564,972, a layer of a plastic material defined in the Marvin et al specification as being a layer of an epoxy or resin is positioned between the layer of abrasive material and the surrounding metal. Epoxies and resins are not as good heat conductors nor are they as strong as the various metals used in the present constructions and such epoxies and resins are more likely than metal to be damaged by heat and cutting stresses. This means that if the epoxy is subjected to relatively high temperatures and stresses, it will lose its strength and can be damaged. This may also substantially shorten the useful life of the honing member and will result in less precise workpiece sizing. This may also slow the honing operation substantially by requiring slower cutting cycles to reduce heat buildup. This is not the case with the present construction wherein the abrasive layer is attached directly to the surrounding metal. This is an important difference between the present construction and constructions such as are shown and described in the Marvin et al patent.

It is also important to note that in the process of producing the honing member 20 illustrated in FIGS. 1–4 and 8–10, the abrasive annular surface 24/26 can take on any one or more of the various tapered arrangements discussed above including one or more tapered portions having different taper rates, a cylindrical portion, a reverse tapered portion, or any combination thereof. Also, since the lead-in tapered portion of the tool is that portion which suffers the most wear during an abrading process, it is recognized and anticipated that such lead-in portion of the inner annular tool surface may include a thicker abrasive layer as compared to other portions of the inner annular abrasive tool surface. For example, the thickness of the lead-in portion 34A of the abrasive layer covering the inner surface of the honing member 20 as shown in FIG. 4A may be 0.015 inches whereas the remaining thickness of the abrasive layer covering portions 34B and 36 may be only 0.010 inches. This construction will help maintain and extend the longevity of the honing member 20.

Figure 11:
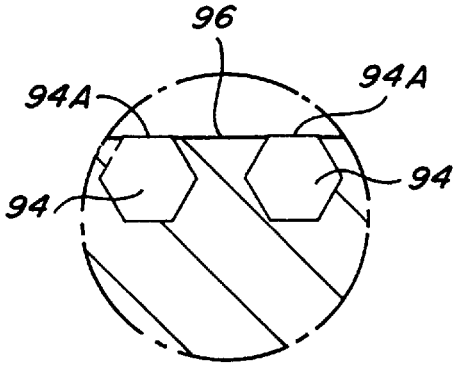
FIG. 11 is an enlarged partial side elevational view of the abrasive layer associated with the inside surface of the present honing member showing the bond matrix between two adjacent abrasive particles upon completion of the electroplating process.
Figure 12:
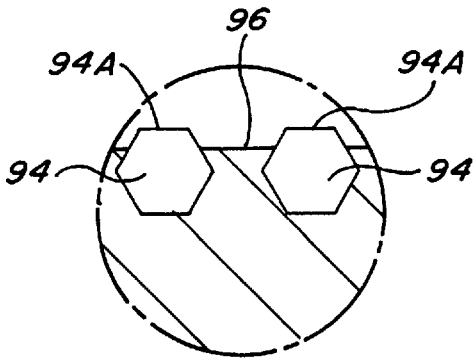
FIG. 12 is similar to FIG. 11 showing some of the bond matrix between adjacent abrasive particles removed to promote a more aggressive cutting action.

It is also important to note that when the present honing member 20 is removed from the forming mandrel 80, the relationship between adjacent abrasive particles 94 and the bond matrix 96 formed therebetween is substantially similar to that illustrated in FIG. 11. In other words, when the abrasive particle layers are electroplated onto the forming mandrel 80 and such mandrel is thereafter removed as previously described, the height or depth of the bonding agent 96 will extend substantially flush and close to the top cutting edge portion 94A of the abrasive grit particles as shown in FIG. 11. This no relief configuration between adjacent grit particles 94 is a direct result of the electroplating mandrel forming manufacturing process discussed above. Although the exposed abrasive particle surfaces 94A (FIG. 11) will provide cutting action in a honing application as a workpiece is moved through the honing member 20, and although some of the bonding agent 96 between adjacent particles will be naturally removed through continued use of the honing member over a period of time due to the fact that the bonding agent is comprised of a softer material as compared to the abrasive particles and will wear during honing thereby exposing more of the abrasive particles for cutting action, a more aggressive cutting action can be easily achieved by actually removing some of the bond matrix between adjacent abrasive particles after the honing member is removed from the forming mandrel so as to expose more of the abrasive particles to the workpiece to be honed as illustrated in FIG. 12. The resultant bond matrix 96 between the abrasive particles 94 as illustrated in FIG. 11 can be reduced after the honing member is separated from the forming mandrel 80 by any one of a variety of different methods such as by mechanical means, electrochemical means, chemical etching, or de-plating the metal bond once the forming mandrel 80 is removed from the honing member. Any one of these methods will remove any predetermined depth or thickness of the bond matrix between adjacent particles so as to form a space between the top surface of the bonding agent 96 and the top cutting edge portion 94A of the abrasive grit particles as illustrated in FIG. 12. This relief area not only enhances the cutting action but this space also provides additional clearance for stock removal during a honing operation and it likewise provides a path for honing oil or other cooling fluids to circulate around the workpiece during a honing operation to cool the same. Still further, this relief area also provides sufficient space so as to apply a substantially smooth, anti-stick, anti-gall agent or coating over the top of the bond matrix so as to prevent the metal chips and shavings produced during a honing operation from building up, collecting and welding or otherwise bonding themselves onto the bond surface between the abrasive particles. This anti-galling coating process is fully described in Applicant's U.S. Pat. No. 5,178,643.

Figure 13:
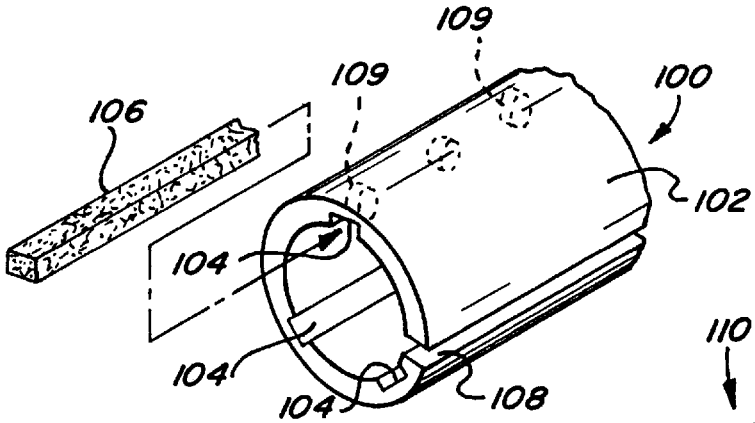
FIG. 13 is a perspective view of another embodiment of an external honing member constructed according to the teachings of the present invention.

FIG. 13 illustrates another embodiment 100 of the present honing tool wherein the tool 100 includes a cylindrical body portion 102 having a plurality of axial grooves or channels 104 formed at spaced locations around the inner surface thereof. Each of the grooves or channels 104 is designed to accommodate a separate abrasive member such as the abrasive stick member 106. A separate stick member 106 is mounted in each of the channels 104 and each extends longitudinally therealong. The type of abrasive material used in making the abrasive stick members 106 will determine the life of the honing member or tool 100 and such stick members 106 can be made of any known abrasive material including superabrasive materials. Also, importantly, abrasive stick members 106 and the corresponding channels 104 can be constructed such that each stick member 106 can be selectively removed and replaced with a new abrasive member 106 when each such member becomes worn or otherwise deformed over time.

The particular surface portion of each stick member 106 which faces inwardly towards the center of the cylindrical body portion 102 may also be formed so as to include tapered inner surfaces such as the various tapered and cylindrical surfaces previously discussed, explained and illustrated with respect to FIGS. 4A and 4B. In addition, similar to the honing member 20, the honing member 100 also includes an axially extending opening 108 which extends the entire length of the cylindrical body portion 102 and functions to enable the member 100 to expand or contract as previously explained with respect to the axial opening 32 associated with honing member 20. In similar fashion, the member 100 also includes at least one counterbore 109 which functions similar to the counterbores 30 (FIGS. 1–4) and are used to properly position and lock the honing member 100 within a suitable mounting fixture such as the mounting fixture illustrated in FIGS. 5 and 6. In this particular embodiment, the inwardly facing surfaces of the separate abrasive stick members 106 provide the work engaging cutting action of the tool 100 for honing any particular cylindrical workpiece. Other embodiments and variations of the present honing tool 100 are also possible so long as the external honing device is capable of honing a relatively large number of parts to some very precise dimension while at the same time enabling a user to make some limited adjustments in the inside diameter of the tool 100 so as to be able to both compensate for wear of the abrasive material and provide some limited diameter adjustment to enable the same tool to be used to hone many more surfaces than would otherwise be the case.

Figure 13A:
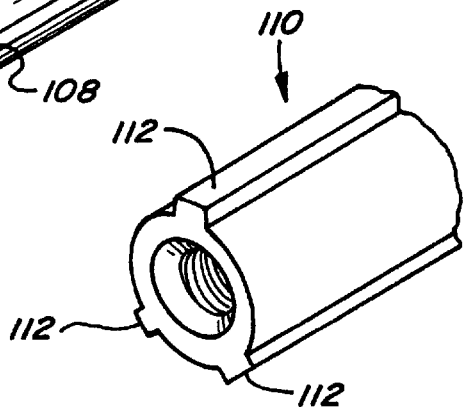
FIG. 13A is a partial perspective view of a forming mandrel which could be used to form the honing member illustrated in FIG. 13.

The honing member 100 can likewise be fabricated through the use of a forming mandrel such as the forming mandrel 110 illustrated in FIG. 13A. Like the forming mandrel 80, the shape and configuration of the outer surface of the forming mandrel 110 will determine the shape and configuration of the inner surface of the honing member 100 when the present tool is formed thereon. In this particular situation, the longitudinally extending projections 112 associated with the forming mandrel 110 will produce the plurality of axial grooves or channels 104 (FIG. 13) formed at spaced locations around the inner surface of the honing member 100. In electro-forming the member 100 onto the forming mandrel 110, any suitable conventional electroplating process may be utilized to form the member 100 since no abrasive particles need to be plated or otherwise bonded onto the outer surface of the forming mandrel 110 in this particular embodiment. The cylindrical body portion 102 of member 100 does not contain any abrasive material and the work engaging portion of the tool is provided solely through the use of the abrasive stick members 106. It is also recognized and anticipated that the cylindrical body portion 102 of the honing member 100 can be fabricated by using any one of a variety of other suitable methods such as machine forming the member 100 out of a piece of metal or other suitable material.

Figure 14:
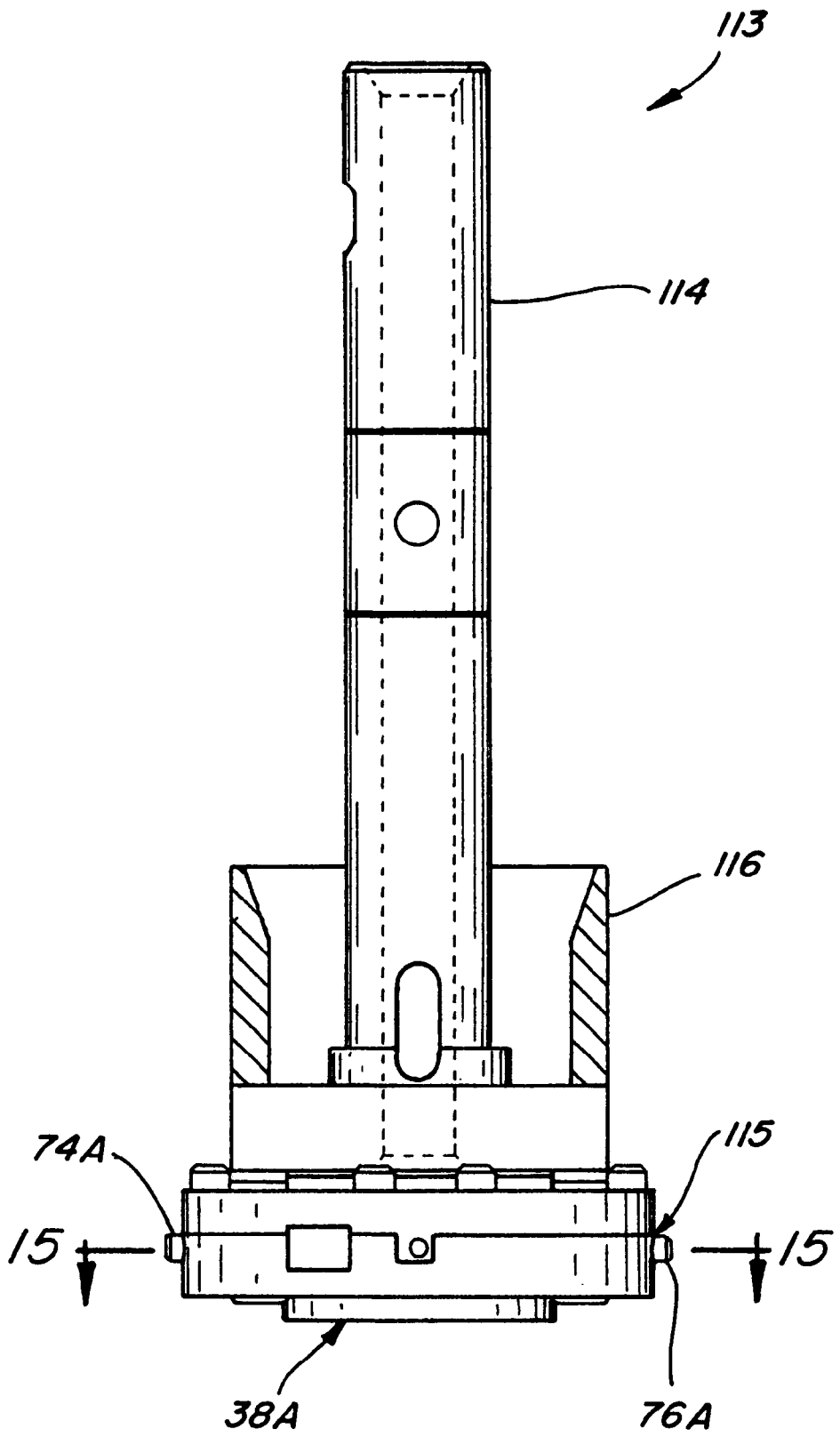
FIG. 14 is a side elevational view partly in cross section of a fixture assembly for supporting the present honing member in a vertical honing position.
Figure 15:
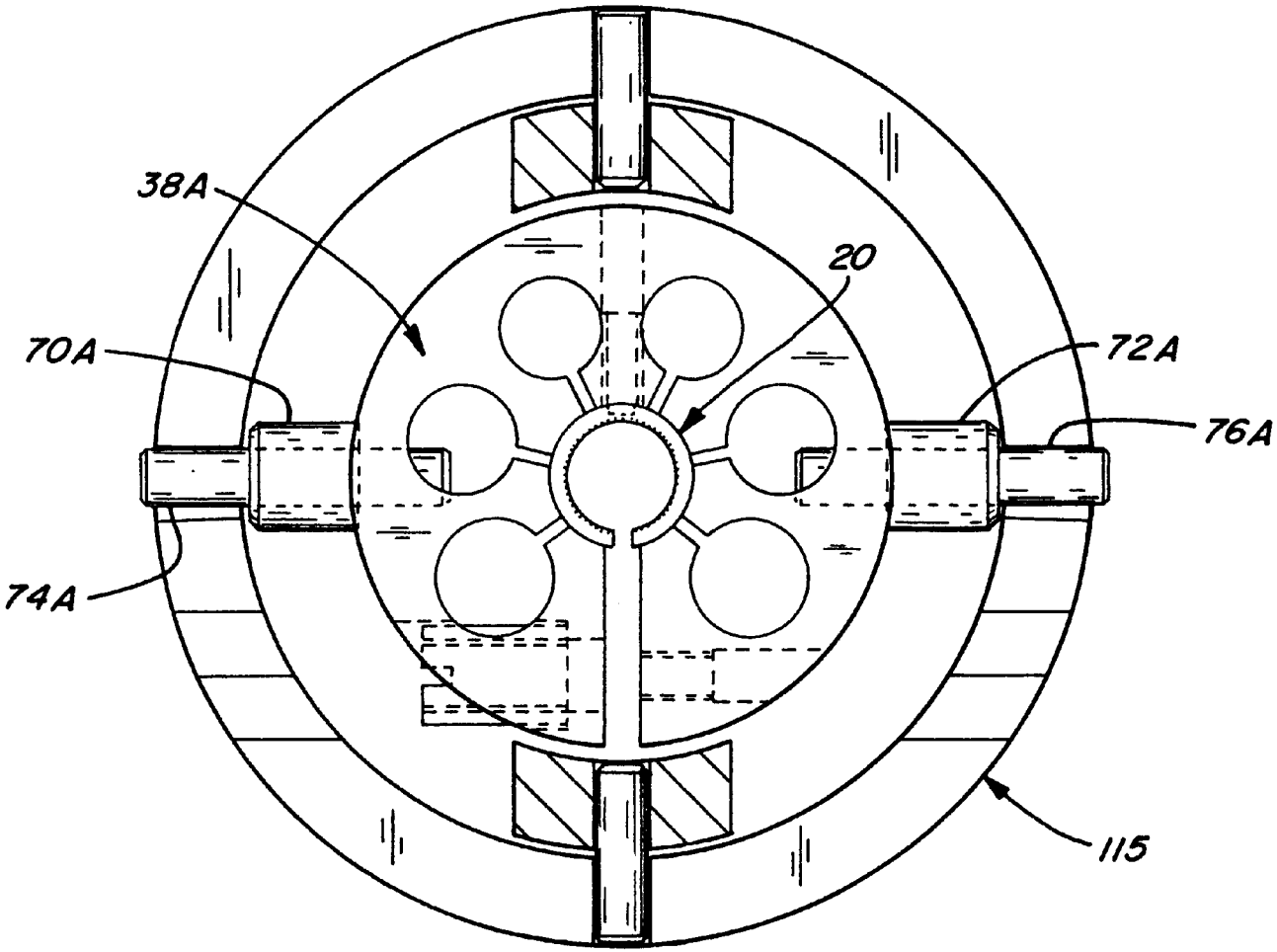
FIG. 15 is a bottom view of the fixture assembly of FIG. 14.

FIGS. 14 and 15 illustrate another fixture assembly 113 which can be used for supporting the present honing members such as the members 20 and 100 in a substantially vertical honing position. In the construction illustrated in FIGS. 14 and 15, there is provided an elongated drive tube 114 which mates with a drive device or spindle on a particular machine such as the honing or bore sizing machine illustrated in FIG. 16. The opposite end of the drive tube 114 is connected to an assembly 115 into which a honing member such as any one of the honing members 20 and 100 described above is positioned. FIG. 15 is a bottom end view of the fixture assembly 113 and more clearly illustrates how the present honing member 20 is positioned and held in operative position within the assembly 115. As illustrated in FIG. 14, the drive tube 114 is vertically oriented and the parts or workpieces to be honed will be fed into the fixture 113 from the bottom end portion thereof. In this regard, the honing member 20 positioned within the assembly 115 (FIG. 15) can remain stationary and the particular workpiece to be honed can be moved vertically up and down during a particular honing operation. Similarly, it is also possible to hold the workpiece stationary and to vertically move the drive tube 114 and associated assembly 115 up and down to complete the honing process. Whether the tool remains stationary while the workpiece moves, or the workpiece remains stationary while the tool moves or reciprocates will depend upon the particular sizing application. In like manner, the honing member could be held in a non-rotating manner while the workpiece is chucked in a rotatable spindle during the honing operation, or the honing member could be rotated while the workpiece is held in a non-rotating manner during a honing operation.

The fixture assembly 113 illustrated in FIG. 14 also includes an upwardly facing annular member 116 which is provided and is used for introducing a coolant material for feeding to the location where the honing takes place. The provision of the coolant containing means 116 suggests that it may be desirable when using this type of construction to form the helical fluting or other surface interruption means on the inner surface of the honing tool such as the fluting previously described with respect to forming mandrel 80 and the helical masking strips 92 illustrated in FIG. 7 so as to permit a lubricant to flow more easily through the honing member as the workpiece is being honed.

As best illustrated in FIG. 15, the fixture assembly 38A used to support the honing member 20 in operative position within the assembly 115 can be identical to or substantially similar in many respects to the fixture construction 38 illustrated in FIGS. 5 and 6. As illustrated in FIG. 15, the support members or gimbals 70A, 72A, 74A and 76A support the fixture assembly 38A within the assembly 115. The fixture assembly 38A functions and operates substantially similar in all respects to the fixture assembly 38 previously described with respect to FIGS. 5 and 6 except that this assembly and the honing member 20 held therewithin is oriented for use in a vertical honing plane. Typically, the workpiece to be honed will be a member having its cylindrical honing surface vertically oriented so as to engage the inner surface of the honing member 20 in any one of the possible stroking scenarios discussed above as best shown in FIG. 16. The workpiece surface may be longer than that portion of the workpiece to be honed such that when the honing operation is complete, that portion of the outer surface of the workpiece which has been honed can be removed or separated from the non-honed portion. In this regard, many workpieces have a feature that allows the workpiece to be held during a honing operation such as a workpiece having an axial passage that allows it to be held by an expandable arbor. In addition, the fixture assembly 113 illustrated in FIGS. 14 and 15 can have their drive tubes 114 connected to members such as the members 120, 122 and 124 illustrated in FIG. 16 which will be hereinafter explained.

Figure 16:
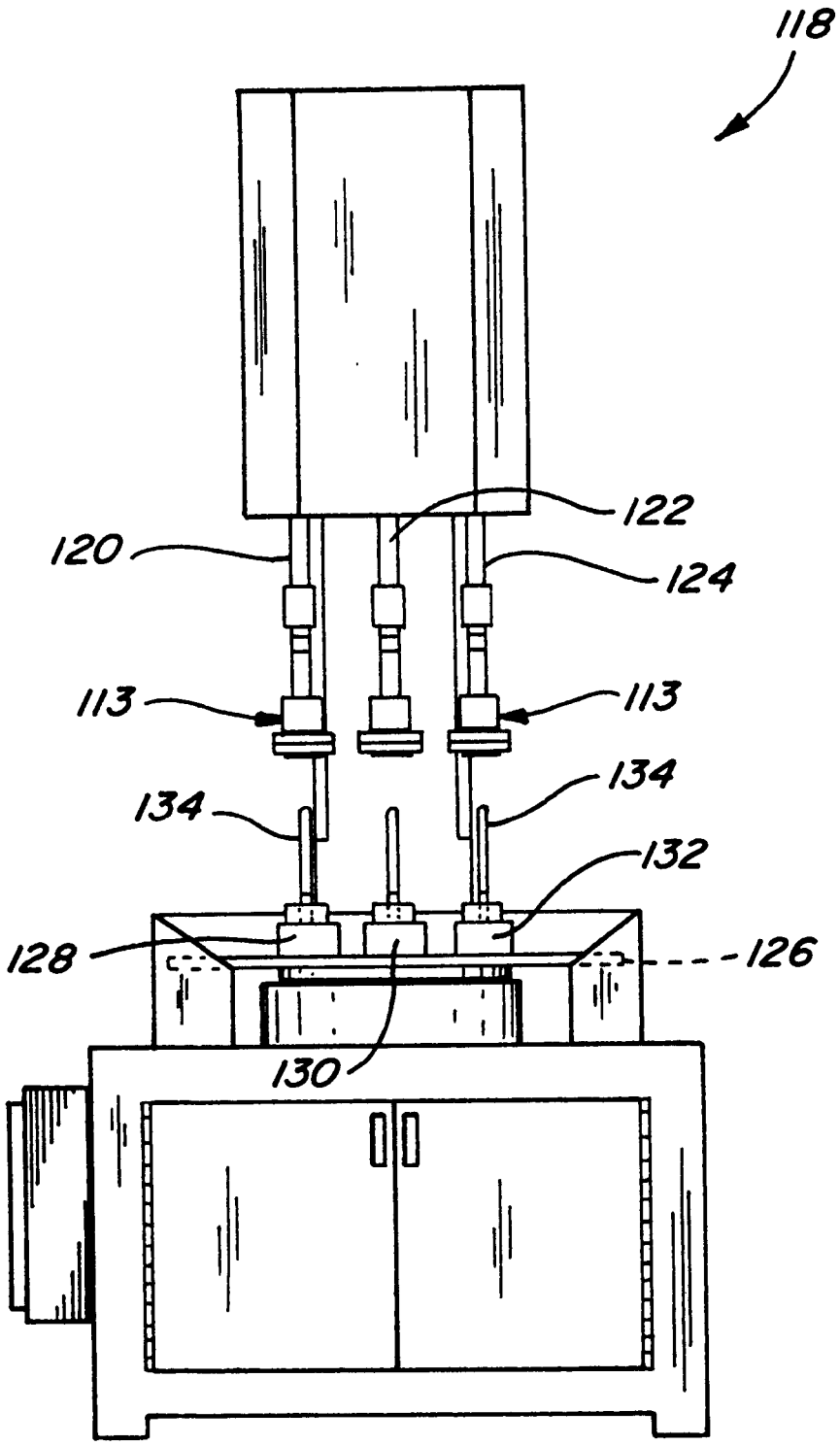
FIG. 16 is a front elevational view of a typical multi-spindle bore sizing machine on which the present external honing members can be mounted.

The present external honing members 20 and 100 can be used in a wide variety of different honing and abrading operations and applications including single-pass and multi-pass operations as well as multi-spindle/multi-tool applications. For example, the bore sizing machine 118 illustrated in FIG. 16 is representative of a multi-spindle programmable machine having three vertical spindles 120, 122 and 124, each spindle being adaptable for holding appropriate tooling such as the fixture assembly 113 which includes honing member 20 in either a fixed/rigid tool holder arrangement or a floating tool holder arrangement to ensure alignment between the inner bore surface 24/26 of the honing member 20 and the cylindrical workpiece 134 to be honed. In the multi-spindle machine 118 illustrated in FIG. 16, such machines typically include a rotary indexing table such as the table 126. The indexing table 126 may include any plurality of stations such as the stations 128, 130 and 132 illustrated in FIG. 16, each indexing station being adaptable for holding a workpiece such as the workpieces 134. The rotary table 126 can be indexed through any number of stations for each cycle, any number of workpieces being continuously cycled on the machine with each of the three external honing members such as the members 20 associated with each of the fixture assemblies 113 progressively decreasing the outside diameter of the workpiece 134. In this situation, the external honing member associated with each of the spindles 120, 122 and 124 may be differently sized with the same or different abrasive grit sizes, or the same sized tool may be used in two or more spindles. Also, importantly, depending upon the particular honing or bore sizing machine being utilized, any number of spindles and any number of workpiece stations may be associated with a particular machine. Also, only some of the workpiece stations associated with the indexing table 126 may actually engage the honing members such as the honing members associated with spindles 120, 122 and 124, whereas the rest of the workpiece stations may be utilized for parts loading and unloading. Typically, a programmable logic controller provides the intelligence for custom control of stroke and spindle speeds, feeds, and position to optimize cycle time, tool life, surface finish and geometry. In any event, after the final tool pass, the outer diameter of the workpiece such as the workpieces 134 illustrated in FIG. 16 is to size, straight and round, with the desired surface texture. The indexing table 126 can also be selectively indexed to skip any number of stations per cycle. This application allows a dramatic increase in production rates depending upon stock removal and the surface finish requirements desired.

In the multi-spindle application illustrated in FIG. 16, typically, the honing member or tool moves through a single up and down stroke and passes over the outer surface of the workpiece only once, removing a predetermined amount of stock. As previously indicated, it is also anticipated and recognized that the honing tool may remain stationary and the workpiece may be cycled up and down through the inner bore of the external honing member to remove a predetermined amount of stock. It is further anticipated and recognized that either the tool or the workpiece may rotate during the honing stroke depending upon the sizing application. Still further, it is recognized and anticipated that the same size external honing tool may be reciprocated any plurality of times over the outer surface of the same cylindrical workpiece in order to achieve a final outer diameter for such workpiece, the tool diameter being contracted on each reciprocating pass or series of passes in order to achieve the final outside workpiece diameter. This operation would constitute a multi-pass tool type arrangement. Other applications and spindle arrangements are likewise possible.

Thus there has been shown and described several different embodiments of a honing member used for honing external cylindrical surfaces on workpieces as well as several different methods of manufacturing such honing members, which honing members and methods fulfill all of the objects and advantages sought therefor. Many changes, modifications, variations and other uses and applications of the present tools and methods will, however, become apparent to those skilled in the art after considering this specification and the accompanying drawings. All such changes, variations, modifications and other uses and applications and other methods of construction which do not depart from the spirit and scope of the invention are deemed to be covered by the present application which is limited only by the claims which follow.

What is claimed is:

1. An apparatus for use in honing the external cylindrical surface of a workpiece, said apparatus comprising an elongated annular metal member having opposed end portions, an outer surface adapted to be held by support means for holding the annular member in a position for honing, and an inner surface defining a passageway extending therethrough from end-to-end adapted for receiving the workpiece, the inner surface of said annular metal member including particles of an abrasive material extending substantially the full length thereof, the metal of the annular metal member being formed around the particles of said abrasive material binding the particles to the inner surface and extending continuously from the inner surface to the outer surface around the annular metal member, the inner surface of said annular metal member having a first abrasive portion of a substantially frusto-conical shape extending from adjacent one end of said annular metal member along a portion of the length thereof to an intermediate location therealong and a second abrasive portion which extends from the opposite end of said first abrasive portion towards the opposite end of said annular metal member, said first abrasive portion being adapted for removing material from the external cylindrical surface of the workpiece at a first rate during a honing operation, said second abrasive portion being adapted for removing material from the external cylindrical surface of the workpiece at a lesser rate than said first abrasive portion, said second abrasive portion being adapted for establishing the final diameter of the external cylindrical surface of the workpiece, and a slot formed through one side portion of said annular metal member extending the full length thereof to facilitate expansion and contraction thereof to radially adjust the diameter of the inner surface of said annular metal member.

2. The apparatus defined in claim 1 wherein said elongated annular member consists substantially of an electroformed metal.

3. The apparatus defined in claim 1 wherein said second abrasive portion includes a second substantially frusto-conical shaped portion extending from the opposite end of said first abrasive portion towards the opposite end of said annular member along at least a portion of the remaining length of said annular member, the rate of axial taper of said second substantially frusto-conical shaped portion being less than the rate of axial taper of said first substantially frusto-conical shaped portion.

4. The apparatus defined in claim 1 wherein said second abrasive portion includes a second substantially frusto-conical shaped portion and a substantially cylindrical portion, said second frusto-conical shaped portion extending from the opposite end of said first substantially frusto-conical shaped portion towards the opposite end of said annular member along an intermediate portion of the remaining length of said annular member to a still further intermediate location therealong, said substantially cylindrical portion extending from the opposite end of said second substantially frusto-conical shaped portion towards the opposite end of said annular member, the rate of axial taper of said second substantially frusto-conical shaped portion being less than the rate of axial taper of said first substantially frusto-conical shaped portion and said substantially cylindrical portion determining the final diameter to which the external cylindrical surface of a workpiece will be honed.

5. The apparatus defined in claim 1 wherein said second abrasive portion includes a reverse tapered portion, said reverse tapered portion being substantially frusto-conical in shape and extending from substantially adjacent the opposite end portion of said annular member along a portion of the length thereof towards said one end of said annular member to an intermediate location therealong, the taper of said reverse substantially frusto-conical shaped portion being such that the minimum diameter thereof is located adjacent to the opposite end portion of said annular member.

6. The apparatus defined in claim 1 wherein a helical groove is formed in the inner surface of said annular member and extends substantially along the full length thereof.

7. The apparatus defined in claim 1 wherein a fluting arrangement is formed in the inner surface of said annular member.

8. The apparatus defined in claim 1 including said support means for holding said annular member in a position for honing, said support means including means for adjusting the width of the slot formed through one side portion of said annular member to facilitate expansion and contraction thereof to adjust the diameter of the inner surface of said annular member.

9. The apparatus defined in claim 8 wherein said support means further includes adjustment means for controlling the maximum amount of width adjustment of said slot.

10. The apparatus defined in claim 8 wherein said support means is capable of supporting said elongated annular member in a horizontal honing position.

11. The apparatus defined in claim 8 wherein said support means is capable of supporting said elongated annular member in a vertical honing position.

12. The apparatus defined in claim 1 wherein said first abrasive portion includes a layer of abrasive material which is thicker than the layer of abrasive material associated with said second abrasive portion.

13. An apparatus for use in honing the external cylindrical surface of a workpiece, comprising an elongated annular metal member having opposed end portions, inner and outer surfaces, and a passageway extending therethrough from end-to-end, the inner metallic surface of said annular member including an abrasive material extending substantially the full length thereof, said abrasive material being formed directly onto and integral with the inner metallic surface of said annular member, the inner surface of said annular member having a first abrasive portion of a substantially frusto-conical shape extending from adjacent one end of said annular member along a portion of the length thereof to an intermediate location therealong and a second abrasive portion which extends from the opposite end of said first abrasive portion towards the opposite end of said annular member, said first abrasive portion removing material from the external cylindrical surface of a workpiece to be honed at a first rate during a honing operation, said second abrasive portion removing material from the external cylindrical surface of the workpiece to be honed at a lesser rate than said first abrasive portion, said second abrasive portion establishing the final diameter of the external cylindrical surface of the workpiece to be honed, and a slot formed through one side portion of said annular member extending the full length thereof to facilitate expansion and contraction thereof to radially adjust the diameter of the inner surface of said annular member, and support means for holding said annular member in position for honing, said support means including means for adjusting the width of the slot formed through one side portion of said annular member to facilitate expansion and contraction thereof to adjust the diameter of the inner surface of said annular member, said support means including a cylindrical shaped member having a central opening formed therethrough for receiving said annular member, said cylindrical member including a plurality of additional openings formed therethrough communicating with said central opening, said cylindrical member further including a passageway formed through one side portion thereof which likewise communicates with said central opening, and means on said cylindrical member for mounting said support means to facilitate better alignment of the annular member with the workpiece.

14. The apparatus defined in claim 13 including means for aligning the slot formed through one side portion of said annular member with the passageway formed through one side portion of said cylindrical member, and means for adjusting the width of said passageway in said cylindrical member and the width of said slot in said annular member to adjust the diameter of the inner surface of said annular member.

15. The apparatus defined in claim 14 including means for enabling said support means to pivot and rotate so as to avoid the exertion of any biasing forces on the workpiece during a honing operation.

16. The apparatus defined in claim 14 wherein said means for aligning the slot formed through one side portion of said annular member with the passageway formed through one side portion of said ° Cylindrical member includes at least one counterbore formed on the outer surface of said annular member at a location opposite said slot, and at least one corresponding opening formed in said cylindrical member and communicating with said central opening, said at least one counterbore and said at least one corresponding opening lying in registration with each other when said annular member is positioned within said central opening and when said slot formed through one side portion of said annular member is aligned with the passageway formed through one side portion of said cylindrical member.

17. The apparatus defined in claim 14 wherein said means for adjusting the width of said passageway in said cylindrical member and the width of said slot in said annular member includes a pair of aligned bores positioned respectively in portions of said cylindrical member on opposite sides of said passageway and an adjusting screw engageable therewith, movement of said adjusting screw varying the width of said passageway which in turn correspondingly varies the width of said slot in said annular member to adjust the diameter of the inner surface of said annular member.

18. The apparatus defined in claim 17 wherein each of said pair of bores are internally threaded and said adjusting screw is externally threaded, the threads associated with one of said bores being of a different thread pitch than the threads associated with the other of said bores, said threaded screw including threads cooperatively engageable respectively with each of said bores, the amount of width adjustment of said passageway being equal to the difference between the relative axial movement of the respective portions of said cylindrical member on opposite sides of said passageway due to the rotation of said threaded screw.

19. An apparatus for use in honing the external cylindrical surface of a workpiece comprising an elongated substantially tubular member having opposed end portions, inner and outer surfaces, and a passageway extending therethrough from end-to-end, a plurality of channels formed at circumferentially spaced locations around the inner surface of said tubular member extending substantially the full length thereof, an abrasive honing member positionable in each of said plurality of channels, each of said abrasive honing members having a workpiece engaging portion disposed so as to face the center of said passageway when mounted in one of said channels, said workpiece engaging portions of said abrasive honing members including elongate portions disposed so as to be located equidistant from the center of the passage for establishing the final diameter of the external cylindrical surface to be honed, and an opening extending through one side portion of said tubular member from end-to-end to facilitate expansion and contraction thereof.

20. The apparatus defined in claim 16 wherein each of said abrasive honing members is selectively removably replaceable from each of said plurality of channels.

21. An apparatus for use in honing the external cylindrical surface of a workpiece comprising an elongated annular member having opposed end portions, inner and outer surfaces, and a passageway extending therethrough from end-to-end, the inner surface of said annular member having a layer of an abrasive material attached directly thereto and extending substantially the length thereof, a slot formed through one side portion of said annular member extending the full length thereof to facilitate expansion and contraction thereof to radially adjust the diameter of the inner surface of said annular member, and a support member for holding said annular member in a position for honing, said support member having a central opening formed therethrough for receiving said annular member and having a passageway through one side portion thereof which communicates with said central opening, said support member further including a plurality of circumferentially spaced openings communicating with said central opening including means for adjusting the width of said passageway in said support member and the width of said slot in said annular member to adjust the diameter of the inner surface of said annular member.

22. The apparatus defined in claim 21 wherein said support member includes gimbal means for supporting said annular member in a manner that enables said annular member to move laterally and angularly during a honing operation.

23. A method of honing the external cylindrical surface of a workpiece comprising the following steps:

(a) providing an annular metal honing member having opposed end portions, an outer surface adapted to be held by support means for holding the annular member in a position for honing and an inner surface defining a passageway extending therethrough for receiving the workpiece, the inner surface of said annular metal member having particles of an abrasive material extending substantially the full length of said inner surface, said metal binding the particles to the inner surface and extending continuously from the inner surface to the outer surface of the annular member, said inner surface having at least a first abrasive tapered portion extending from adjacent one end of said honing member along a portion of the length thereof to an intermediate location therealong and a second abrasive portion which extends from the opposite end of said at least first abrasive tapered portion towards the opposite end of said honing member, and a slot extending through one side portion of said honing member from end-to-end to facilitate expansion and contraction thereof, said inner surface being engageable with a workpiece to hone the external cylindrical surface of such workpiece;

(b) adjusting the diameter of the inner surface of said honing member using said support means for holding the honing member to maintain a predetermined diameter for the external cylindrical surface of the workpiece to be honed; and (c) honing the external cylindrical surface of a workpiece by engaging such workpiece with the inner abrasive surface of said honing member and moving the workpiece through said honing member by providing relative axial and rotational motion between said honing member and the workpiece for a predetermined number of honing strokes, each honing stroke comprising relative movement of the workpiece through the passageway of the honing member in one direction and reciprocal relative movement of the workpiece through the passageway of the honing member in the opposite direction, said first abrasive tapered portion removing material from the external cylindrical surface of the workpiece at a first rate during a honing operation, said second abrasive portion removing material from the external cylindrical surface of the workpiece at a lesser rate than said first abrasive tapered portion, said second abrasive portion establishing the final diameter of the external cylindrical surface of the workpiece being honed for that particular honing member.

24. The method defined in claim 23 wherein the relative axial motion between said honing member and the workpiece to be honed is accomplished by holding the honing member stationary and moving the workpiece relative thereto.

25. The method defined in claim 23 wherein the relative axial motion between the honing member and the workpiece to be honed is accomplished by holding the workpiece stationary and moving the honing member relative thereto.

26. The method defined in claim 23 wherein the relative rotational motion between said honing member and the workpiece to be honed is accomplished by rotating said honing member.

27. The method defined in claim 23 wherein the relative rotational motion between said honing member and the workpiece to be honed is accomplished by rotating the workpiece.

28. The method defined in claim 23 wherein the predetermined number of honing strokes for accomplishing the honing operation includes a single honing stroke, the final diameter of the external cylindrical surface of the workpiece being honed being established at the completion of said single honing stroke.

29. The method defined in claim 23 wherein the predetermined number of honing strokes for accomplishing the honing operation includes a plurality of honing strokes, the final diameter of the external cylindrical surface of the workpiece being honed being established at the completion of said plurality of honing strokes.

30. The method defined in claim 23 wherein said honing member is positioned and held within a mounting fixture which orients said honing member in a horizontal honing position, the honing of the external cylindrical surface of a workpiece being accomplished in a horizontal orientation.

31. The method defined in claim 23 wherein said honing member is positioned and held within a mounting fixture which orients said honing member in a vertical honing position, the honing of the external cylindrical surface of a workpiece being accomplished in a vertical orientation.

32. The method defined in claim 23 including providing a plurality of annular honing members, each honing member having at least a portion of the second abrasive portion of the inner surface thereof sized to a different final finishing diameter, each honing member removing a predetermined amount of material when moved relative to the workpiece to be honed, said plurality of honing members being arranged in a progressively decreasing sizing order based upon the final finishing diameter associated with each of said plurality of honing members from said largest diameter to said smallest diameter, and thereafter honing the external cylindrical surface of a workpiece with each of said honing members such that the outside diameter of the workpiece will be progressively decreased as the workpiece is honed with each successive honing member.

33. The method defined in claim 32 wherein said plurality of honing members are utilized on a bore sizing machine having a single tool holding spindle associated therewith.

34. The method defined in claim 32 wherein said plurality of honing members are utilized on a bore sizing machine having a plurality of tool holding spindles associated therewith, said plurality of honing members being attached to said plurality of tool holding spindles in a progressively decreasing sizing order based upon the final finishing diameter of each such honing member, and thereafter cycling a workpiece to be honed through a honing operation with each of said plurality of honing members such that the outside diameter of the workpiece is progressively decreased as such workpiece is cycled into engagement with each of said honing members.

35. An apparatus for use in honing the external cylindrical surface of a workpiece, comprising an elongated annular member having opposed end portions, inner and outer surfaces, and a passageway extending therethrough from end-to-end, the inner surface of said annular member having a layer of an abrasive material attached directly thereto and extending substantially the length thereof, a slot formed through one side portion of said annular member extending the full length thereof to facilitate expansion and contraction thereof to radially adjust the diameter of the inner surface of said annular member, and a support member for holding said annular member in a position for honing, said support member having a central opening formed therethrough for receiving said annular member and having a passageway through one side portion thereof which communicates with said central opening, said support member further including a plurality of circumferentially spaced openings communicating with said central opening including means for adjusting the width of said passageway in said support member and the width of said slot in said annular member to adjust the diameter of the inner surface of said annular member, and said support member including means for aligning the slot formed in said annular member with the passageway formed in said support member.

36. An apparatus for use in honing the external cylindrical surface of a workpiece comprising an elongated annular member having opposed end portions, inner and outer surfaces, and a passageway extending therethrough from end-to-end, the inner surface of said annular member having a layer of an abrasive material attached directly thereto and extending substantially the length thereof, a slot formed through one side portion of said annular member extending the full length thereof to facilitate expansion and contraction thereof to radially adjust the diameter of the inner surface of said annular member, and a support member for holding said annular member in a position for honing, said support member having a central opening formed therethrough for receiving said annular member and having a passageway through one side portion thereof which communicates with said central opening, said support member further including a plurality of circumferentially spaced openings communicating with said central opening including means for adjusting the width of said passageway in said support member and the width of said slot in said annular member to adjust the diameter of the inner surface of said annular member, and said support member including means for controlling the maximum amount of width adjustment of said slot in said annular member, said means including a threaded bore in said support member adaptable to receive a threaded member, said threaded member having an end portion that is adjustable to be positioned in the passageway of said support member in spaced relationship to one side of said passageway, the position of the end portion of said threaded member controlling the maximum amount of width adjustment of said slot.

* * * * *

UNITED STATES PATENT AND TRADEMARK OFFICE

CERTIFICATE OF CORRECTION

PATENT : 6,074,282

DATED : June 13, 2000

INVENTOR(S): John J. Schimweg

It is certified that error appears in the above-identified patent and that said Letters Patent is hereby corrected as shown below:

Col. 18, line 51, "° Cylindrical" should be --cylindrical--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*